US008955596B2

(12) United States Patent
Yun et al.

(10) Patent No.: US 8,955,596 B2
(45) Date of Patent: Feb. 17, 2015

(54) DAMPING APPARATUS FOR MOONPOOL

(75) Inventors: Seong Deok Yun, Geoje-si (KR); Gurbachan Virk, Pleasanton, CA (US)

(73) Assignees: Daewoo Shipbuilding & Marine Engineering Co., Ltd., Seoul (KR); Transocean Sedco Forex Ventures Limited, Grand Cayman (KY)

( * ) Notice: Subject to any disclaimer, the term of this patent is extended or adjusted under 35 U.S.C. 154(b) by 0 days.

(21) Appl. No.: 13/878,424

(22) PCT Filed: Jun. 20, 2011

(86) PCT No.: PCT/KR2011/004467
§ 371 (c)(1),
(2), (4) Date: Jul. 16, 2013

(87) PCT Pub. No.: WO2012/046942
PCT Pub. Date: Apr. 12, 2012

(65) Prior Publication Data

US 2013/0292131 A1 Nov. 7, 2013

(30) Foreign Application Priority Data

Oct. 8, 2010 (KR) ..... 10-2010-0098082

(51) Int. Cl.
*E21B 15/02* (2006.01)
*B63B 35/44* (2006.01)
(Continued)

(52) U.S. Cl.
CPC . *E21B 15/02* (2013.01); *B63J 2/02* (2013.01); *B63B 19/28* (2013.01); *B63B 35/4413* (2013.01); *B63B 2003/147* (2013.01)
USPC ..... 166/352; 166/355; 166/358; 114/264; 405/202

(58) Field of Classification Search
CPC ..... B63B 35/4413; E21B 19/006
USPC ..... 166/352, 355, 358; 114/264; 175/7; 405/195.1, 196, 202, 211, 217
See application file for complete search history.

(56) References Cited

U.S. PATENT DOCUMENTS 3,894,640 A * 7/1975 Crooke et al. ..... 414/137.7
3,902,554 A 9/1975 Hooper
(Continued)

FOREIGN PATENT DOCUMENTS

GB 2184985 A 7/1987
JP 59-89101 U 6/1984
(Continued)

OTHER PUBLICATIONS

International Search Report dated Jan. 13, 2012 of PCT/KR2011/004467 which is the parent application—2 pages.
(Continued)

*Primary Examiner* — Matthew Buck
(74) *Attorney, Agent, or Firm* — Knobbe Martens Olson & Bear LLP

(57) ABSTRACT

Provided is a damping apparatus for a moonpool, which has a simple driving mechanism. The damping apparatus includes one or more damping plates which cover a moonpool of a hull entirely or partially. The damping plates are pivotally hinged to a sidewall of the moonpool, and one or more conveying units are disposed above the moonpool to convey drilling equipment. Driving wires are coupled between the conveying units and the damping plates, and the conveying force of the conveying units is transferred through the driving wires to the damping plates. Thus, the damping plates are pivoted to open and close the moonpool entirely or partially.

8 Claims, 2 Drawing Sheets

(51) Int. Cl.

| | |
|---|---|
| ***B63J 2/02*** | (2006.01) |
| ***B63B 19/28*** | (2006.01) |
| *B63B 3/14* | (2006.01) |

(56) References Cited

U.S. PATENT DOCUMENTS

| | | | | |
|---|---|---|---|---|
| 4,069,785 | A * | 1/1978 | Bordes | 114/47 |
| 6,155,193 | A * | 12/2000 | Syvertsen et al. | 114/230.12 |
| 6,321,675 | B1 * | 11/2001 | Dybdahl et al. | 114/264 |
| 6,503,022 | B1 * | 1/2003 | Nuss | 405/195.1 |
| 6,932,553 | B1 | 8/2005 | Roodenburg et al. | |
| 7,628,225 | B2 * | 12/2009 | Petersson et al. | 175/5 |
| 2007/0163782 | A1 | 7/2007 | Keener | |
| 2009/0223660 | A1 * | 9/2009 | Petersson | 166/85.4 |

FOREIGN PATENT DOCUMENTS

| | | | |
|---|---|---|---|
| JP | 63-68485 | A | 3/1988 |
| JP | 2001-071989 | A | 3/2001 |
| JP | 2002-234484 | A | 8/2002 |
| KR | 20-0429244 | Y1 | 10/2006 |
| KR | 2009034068 | A * | 4/2009 |
| KR | 10-2010-0069983 | A | 6/2010 |
| KR | 20-2010-0007184 | U | 7/2010 |
| WO | WO 9718987 | A1 * | 5/1997 |

OTHER PUBLICATIONS

Office Action dated Mar. 10, 2014 of corresponding Japanese Patent Application No. 2013-532708—4 pages.

Office Action dated Jun. 19, 2014 of corresponding Singapore Patent Application No. 201302615-8—15 pages.

* cited by examiner

DAMPING APPARATUS FOR MOONPOOL

CROSS-REFERENCE(S) TO RELATED APPLICATION

This application claims priority of Korean Patent Application No. 10-2010-0098082, filed on Oct. 8, 2010, in the Korean Intellectual Property Office, which is hereby incorporated by reference in its entirety.

BACKGROUND OF THE INVENTION

1. Field of the Invention

The present invention relates to a damping device for a moonpool, and more particularly, to a damping apparatus for a moonpool, which has a simple driving mechanism.

2. Description of the Related Art

With the development of offshore drilling techniques, drill ships equipped with drilling equipment suitable for development of small marginal fields or deep-sea oil fields have been developed.

In a conventional offshore drilling, rig ships or fixed type platforms have been mainly used, which can be moved only by tugboats and are anchored at a position on the sea using a mooring gear to conduct an oil drilling operation. In recent years, however, so-called drill ships have been developed and used for offshore drilling. The drill ships are provided with advanced drilling equipments and have structures similar to typical ships such that they can make a voyage using their own power. Since drill ships have to frequently move in order for development of small marginal fields, they are constructed to make a voyage using their own power, without assistance of tugboats.

Meanwhile, a moonpool through which a variety of equipments for a drilling operation pass is installed in an offshore platform such as a drill ship or a drill rig. The moonpool has a hollow parallelepiped or cylindrical structure through which a variety of equipments are vertically moved between an upper deck and a bottom of an offshore platform.

As the size of an offshore platform increases, a moonpool also becomes larger. Accordingly, in the case of a parallelepiped moonpool, a large moonpool with a size of 12-13 m (a length in a width direction of an offshore platform)×14-25 m (a length in a front and rear direction of an offshore platform) has been used. Such a moonpool is indispensable in terms of the purpose of a drill ship, but is very disadvantageous in terms of anchoring of the ship, voyage stability and voyage performance of the ship.

In particular, a sloshing phenomenon is induced by a relative movement between seawater flowing into the moonpool and seawater outside the hull of the ship. The sloshing phenomenon may cause an increase in voyage resistance, a decrease in voyage speed, an increase in power consumption and fuel consumption, and a damage of a hull.

In addition, an overflowing phenomenon is induced by a fluid movement inside the moonpool. The overflowing phenomenon may serve as a factor that deteriorates a worker's safety and work efficiency.

Accordingly, a damping plate which opens and closes the moonpool is installed in order to minimize the movement resistance of the hull and effectively prevent the overflowing phenomenon caused by high waves. One or two damping plates are hinged to a sidewall of the moonpool to open and close the moonpool. The opening and closing operation of the damping plates is handled by a deck crane disposed at the deck of the hull.

In the case of an arctic drill ship, however, since a derrick disposed above a moonpool is configured with an enclosed structure, a deck crane of a hull cannot approach the inside of the moonpool. Therefore, a separate driving mechanism (e.g., a winch or a cylinder) for driving a damping plate is required within the moonpool and the derrick disposed above the moonpool. Consequently, installation cost increases and interference with other articles is caused, making an installation layout cumbersome.

SUMMARY OF THE INVENTION

An aspect of the present invention is directed to a damping apparatus for a moonpool, in which a driving mechanism of a damping plate for opening and closing the moonpool is configured very simply to thereby reduce installation cost, and interference with other articles inside the moonpool is minimized to thereby make an installation layout convenient.

According to an embodiment of the present invention, a damping apparatus for a moonpool, which has one or more damping plates covering the moonpool entirely or partially, is characterized in that the damping plates are pivotally hinged to a sidewall of the moonpool, one or more conveying units are disposed above the moonpool to convey drilling equipment, one or more driving wires are coupled between the damping plates and the conveying units, and the conveying force of the conveying units is transferred through the driving wires to the damping plates, so that the damping plates are pivoted.

A pair of driving wires may be coupled to the damping plates in a bilateral symmetry.

The damping plates may include a pair of damping plates installed to face each other in a bow direction and a stern direction of a hull.

An enclosed derrick may be disposed above the moonpool, one or more conveying units may be installed inside the enclosed derrick to convey drilling equipment, and the driving wires may be coupled such that the driving wires are guided between the conveying units and the damping plates by a plurality of sheaves.

The conveying unit may be one of a blowout preventer (BOP) trolley conveying a BOP and a lower marine riser package (LMRP) crane conveying an LMRP.

According to another embodiment of the present invention, a damping apparatus for a moonpool, which has one or more damping plates at least partially opening and closing the moonpool located at the center of an arctic drill ship, is characterized in that an enclosed derrick is disposed above the moonpool, one or more conveying units are installed inside the enclosed derrick to convey drilling equipment, and one or more driving wires are coupled between the conveying units and the damping plates and are guided by a plurality of sheaves.

The conveying unit may be a BOP trolley conveying a BOP, one end of the driving wire may be fixed to an end of the damping plate opposite to a hinge part, and the other end of the driving wire may be fixed to the BOP trolley.

The conveying unit may be an LMRP crane conveying an LMRP, one end of the driving wire may be separably coupled to an arm of the LMRP crane, and the driving wire may be guided through a first sheave installed at one end of the damping plate and a second sheave installed in the sidewall of the moonpool.

DETAILED DESCRIPTION OF EXEMPLARY EMBODIMENTS

Figure 1:
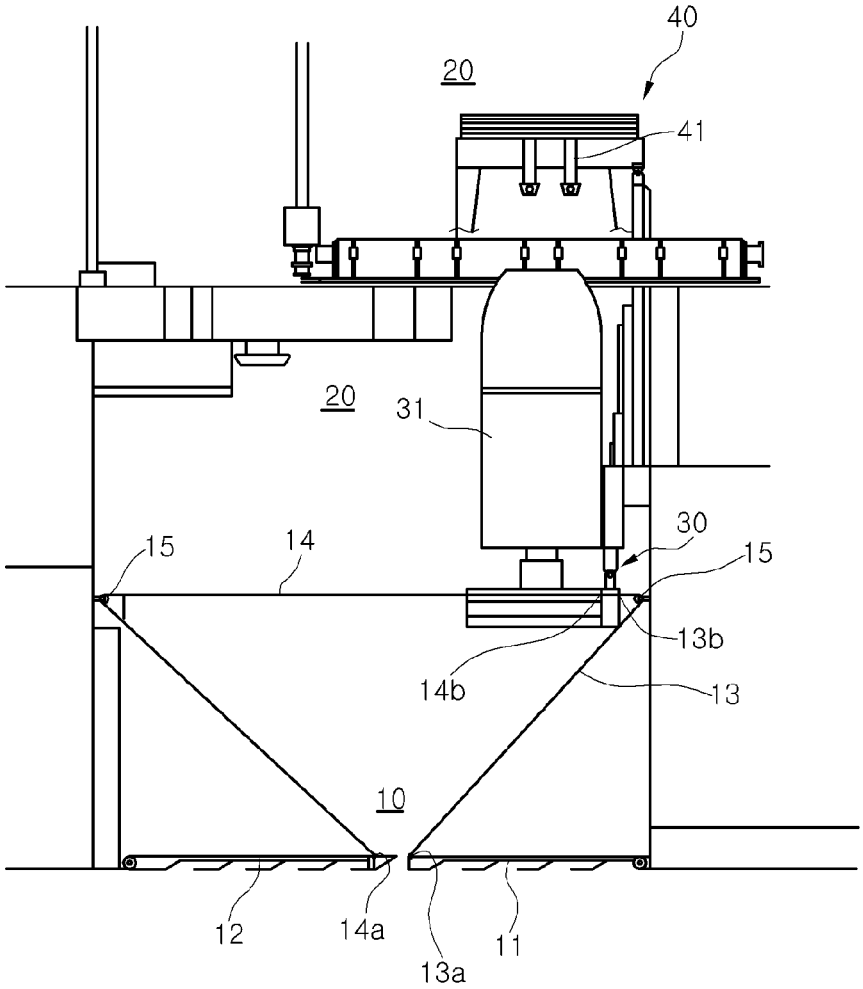
FIG. 1 is a side view illustrating a damping apparatus for a moonpool according to an embodiment of the present invention.

Exemplary embodiments of the present invention will be described below in detail with reference to the accompanying drawings. Throughout the disclosure, like reference numerals refer to like parts throughout the various figures and embodiments of the present invention.

Figure 2:
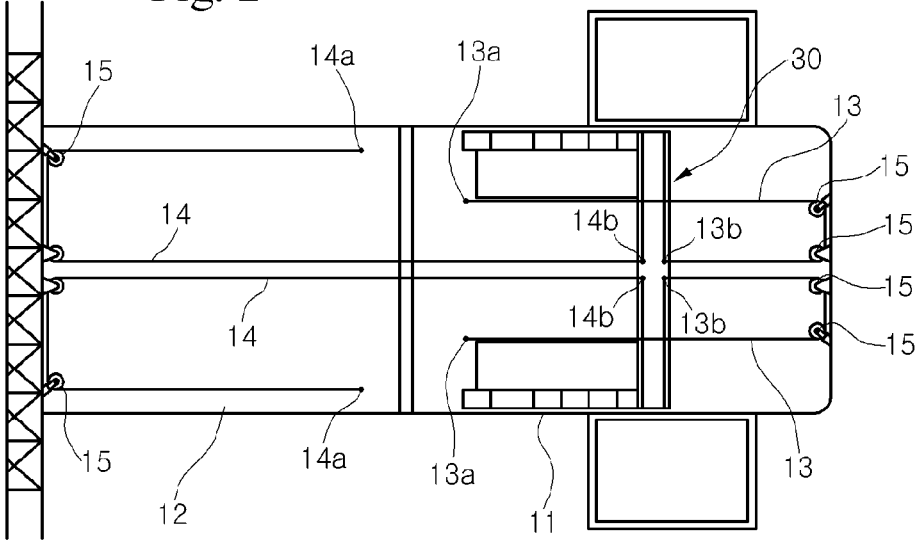
FIG. 2 is a plan view illustrating the damping apparatus of FIG. 1.

FIGS. 1 and 2 illustrate a damping apparatus for a moonpool according to an embodiment of the present invention.

As illustrated in FIG. 1, the damping apparatus for the moonpool according to the embodiment of the present invention includes one or more damping plates 11 opening and closing the moonpool 10 of a hull entirely or partially. The damping plates 11 are pivotally hinged to a sidewall of the moonpool 10, such that the moonpool 10 is opened and closed entirely or partially.

As illustrated in FIGS. 1 and 2, a pair of damping plates 11 may be pivotally hinged in a bow direction and in a stern direction of the hull, respectively. The damping plates 11 open and close the moonpool 10 entirely or partially, minimizing movement resistance of the hull and effectively preventing overflowing caused by high waves.

Meanwhile, a derrick 20 in which drilling equipments are integrated is installed above the moonpool 10, and drilling equipments such as a blowout preventer (BOP) 31 and a lower marine riser package (LMRP) are installed inside the derrick 20.

In order to move the drilling equipments between a usage position and a storage position, handling units 30 and 40 are installed as conveying units that convey the drilling equipments. Examples of the handling units installed inside the derrick 20 include a BOP trolley 30 conveying the BOP 31, an LMRP crane 40 conveying the LMRP, and so on.

One or more driving wires 13 and 14 are coupled to the damping plates 11 and 12, and the driving force is transferred through the driving wires 13 and 14 to the damping plates 11 and 12. One or more damping plates may be installed in one moonpool. In this embodiment, the installation of two damping plates is exemplarily illustrated. That is, the damping plate 11 is installed on the bow side, and the damping plate 12 is installed on the stern side. The installation of the damping plates on the bow side and the stern side is merely exemplary. Damping plates may be installed on the portside and the starboard side, respectively, or three or more damping plates may be installed.

According to this embodiment of the present invention, a pair of driving wires 13 may be coupled to the damping plate 11 installed on the bow side, and another pair of driving wires 14 may be coupled to the damping plate 12 installed on the stern side.

The respective driving wires 13 and 14 are guided through a plurality of sheaves 15. In particular, it is preferable that two or more driving wires 13 and 14 are symmetrically installed on the left and right sides of the damping plates 11 and 12, such that the damping plates 11 and 12 are harmoniously opened and closed.

The driving wires 13 and 14 are coupled to the conveying units 30 and 40 inside the derrick 20. When the conveying units 30 and 40 are operated, the conveying force of the conveying units 30 and 40 is transferred through the driving wires 13 and 14 to the damping plates 11 and 12. Accordingly, the damping plates 11 and 12 are pivoted to open and close the moonpool 10.

Meanwhile, in the case of an arctic drill ship, since the derrick 20 is configured with an enclosed structure blocked from the exterior, a deck crane installed in the deck of the hull cannot approach the inside of the derrick 20. Therefore, the driving wires 13 and 14 are coupled between the conveying units 30 and 40 installed inside the enclosed derrick 20 and the damping plates 11 and 12. Therefore, the damping plates 11 and 12 can be operated conveniently by the conveying operation of the conveying units 30 and 40. Consequently, the present invention can be very usefully applied to the arctic drill ship with the enclosed derrick 20.

According to the embodiment of FIGS. 1 and 2, the driving wires 13 and 14 are coupled to the BOP trolley 30, and the conveyance of the driving wires 13 and 14 is guided through the plurality of sheaves 15 by the conveying operation of the BOP trolley 30. In this manner, the damping plates 11 and 12 may be operated. According to one embodiment, ends 13*a* and 14*a* of the driving wires 13 and 14 may be fixed to ends of the damping plates 11 and 12 opposite to the hinge parts, and the other ends 13*b* and 14*b* of the driving wires 13 and 14 may be fixed to the BOP trolley 30.

While the damping plates 11 and 12 maintain the opened state or the closed state, the driving wires 13 and 14 may be separated from the BOP trolley 30.

In order to drive the damping plate 11 installed on the bow side, the driving wire 13 may be coupled to the BOP trolley 30, and the damping plate 11 installed on the bow side may be opened by moving the BOP trolley 30 in the stern direction or may be closed by moving the BOP trolley 30 in the bow direction. In this case, it is preferable that the driving wires 14 for driving the damping plate 12 installed on the stern side is not coupled to the BOP trolley 30.

Meanwhile, in order to drive the damping plate 12 installed on the stern side, the driving wire 14 may be coupled to the BOP trolley 30, and the damping plate 12 installed on the stern side may be opened by moving the BOP trolley 30 in the bow direction or may be closed by moving the BOP trolley 30 in the stern direction. In this case, it is preferable that the driving wires 13 for driving the damping plate 11 installed on the bow side is not coupled to the BOP trolley 30.

Locking units (not shown), such as a cylinder or a control stand, which maintain the opening and closing operation of the damping plates 11 and 12, may be installed at the respective damping plates 11 and 12.

Figure 3:
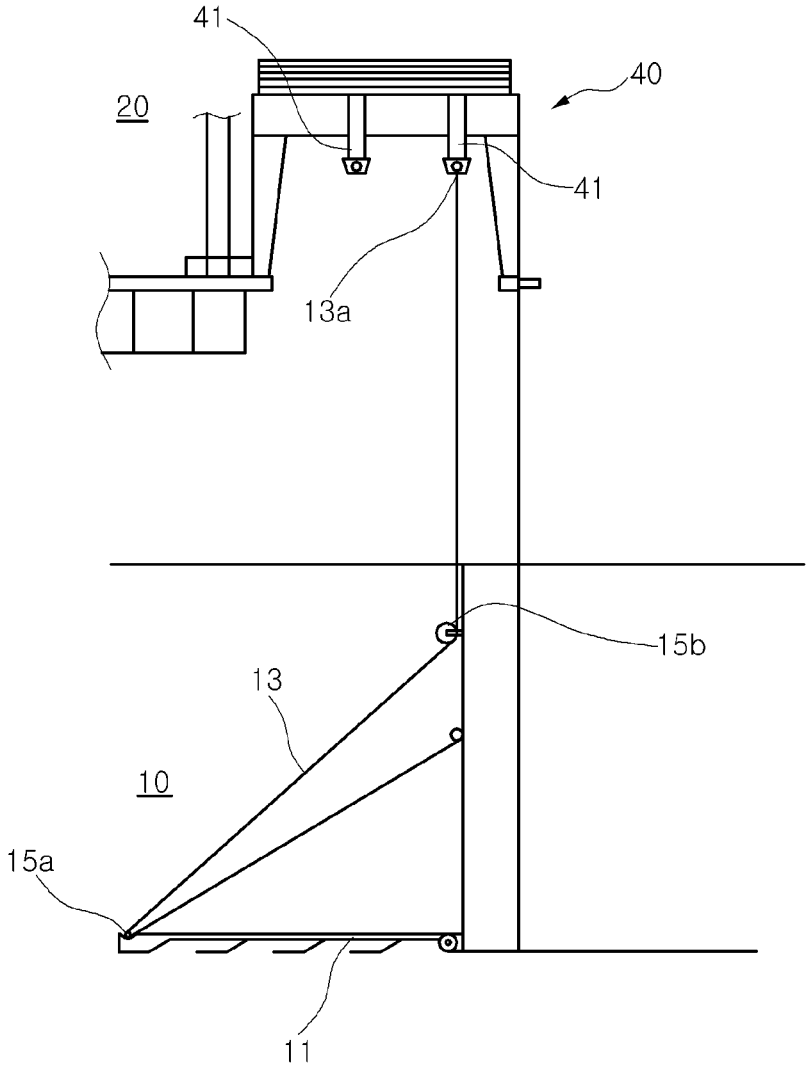
FIG. 3 is a side view illustrating a damping apparatus for a moonpool according to another embodiment of the present invention.

In a damping apparatus for a moonpool according to another embodiment of the present invention, as illustrated in FIG. 3, a damping plate 11 installed on a bow side is operated by coupling a driving wire 13 to an LMRP crane 40. Although not shown in FIG. 3, a damping plate 12 installed on a stern side and a driving wire 14 coupled for driving the damping plate 12 are operated in the same principle, and thus, detailed description thereof will be omitted.

In particular, according to the embodiment of FIG. 3, one end 13*a* of the driving wire 13 is separably coupled to an arm 41 of the LMRP crane 40, and the driving wire 13 is guided and conveyed through one or more first sheaves 15*a* installed on one end of the damping plate 11 and one or more second sheaves 15*b* installed in a sidewall of the moonpool 10. Accordingly, as the LMRP crane 40 is moved, the driving wire 13 is moved and the damping plate 11 is pivoted to open and close the moonpool 10.

As described above, conveying units 30 and 40 installed above the moonpool 10 and the damping plates 11 and 12 are coupled together through the driving wires 13 and 14. The conveying force of the conveying units 30 and 40 is transferred through the driving wires 13 and 14 to the damping plates 11 and 12. In this manner, the damping plates 11 and 12 are driven. Therefore, in configuring a driving mechanism for the damping plate, a separate driving device is not applied, contributing to the reduction of installation cost. In particular, in a ship such as the arctic drill ship in which the enclosed derrick 20 is installed, if the approach of the deck crane is impossible, the present invention can be applied very usefully.

Furthermore, since the damping plates 11 and 12 are driven by the conveyance of the driving wires 13 and 14, interference with other articles inside the moonpool is minimized, thereby making the installation layout convenient.

While the embodiments of the present invention has been described with reference to the specific embodiments, it will be apparent to those skilled in the art that various changes and modifications may be made without departing from the spirit and scope of the invention as defined in the following claims.

What is claimed is:

1. A damping apparatus for a moonpool in a ship having an enclosed derrick disposed over the moonpool, the apparatus comprising:

a damping plate comprising a proximal end and a distal end, wherein the proximal end of the damping plate is hinged to a first point of a sidewall of the moonpool such that the damping plate is pivotally movable between an open position and a closed position;

a driving mechanism disposed within the enclosed derrick and configured to move drilling equipment within the enclosed derrick;

a sheave attached to the sidewall at a second point of the sidewall, which is higher than the first point;

a cable coupled between the damping plate and the driving mechanism via the sheave such that the driving mechanism drives pivotal movement of the damping plate in addition to moving the drilling equipment.

2. The damping apparatus according to claim 1, further comprising another cable coupled between the damping plate and the driving mechanism via a sheave, wherein the cable and the other cable are coupled to the damping plate in a bilateral symmetry.

3. The damping apparatus according to claim 1, wherein the drilling equipment comprises a lower marine riser package (LMRP), and the mechanism is configured to move the LMRP.

4. The apparatus of claim 1, wherein the cable is connected to the distal end of the damping plate.

5. The apparatus of claim 1, wherein the drilling equipment comprises a blowout preventer (BOP), and the driving mechanism is configured to move the BOP.

6. The apparatus of claim 5, wherein the driving mechanism comprises a trolley for conveying the BOP and is configured to drive pivotal movement of the damping plate while the trolley moves.

7. The apparatus of claim 1, further comprising:

an additional damping plate which comprises a proximal end and a distal end, wherein the proximal end of the additional damping plate is hinged to another sidewall of the moonpool such that the damping plate is pivotally movable between an open position and a closed position, an additional cable coupled between the additional damping plate and the driving mechanism such that the driving mechanism drives pivotal movement of the additional damping plate in addition to moving drilling equipment.

8. The apparatus of claim 7, wherein the driving mechanism comprises a trolley for conveying the drilling equipment and is configured to move the trolley in a first direction toward a bow of the ship and further configured to move the trolley in a second direction toward a stern of the ship, wherein the apparatus is configured such that the driving mechanism drives the pivotal movement of the damping plate toward its open position when the trolley moves in the first direction, wherein the apparatus is further configured such that the driving mechanism drives the pivotal movement of the additional damping plate toward its open position when the trolley moves in the second direction.

* * * * *